US005613278A

United States Patent [19]

Temburg

[11] Patent Number: 5,613,278

[45] Date of Patent: Mar. 25, 1997

[54] CLEARANCE ADJUSTMENT IN THE FEEDING DEVICE OF A FIBER PROCESSING TEXTILE MACHINE

[75] Inventor: Konrad Temburg, Mönchengladbach, Germany

[73] Assignee: Trützschler GmbH & Co. KG, Mönchengladbach, Germany

[21] Appl. No.: 551,608

[22] Filed: Nov. 1, 1995

[30] Foreign Application Priority Data

Nov. 19, 1994 [DE] Germany ..... 44 41 254.1

[51] Int. Cl.[6] ..... D01G 9/06; D01G 9/16

[52] U.S. Cl. ..... 19/105

[58] Field of Search ..... 19/64.5, 86, 96, 19/97.5, 105, 204

[56] References Cited

U.S. PATENT DOCUMENTS

| | | | |
|---|---|---|---|
| 2,128,130 | 8/1938 | Farrar | 19/105 |
| 3,571,859 | 3/1971 | Doublebsky et al. | 19/105 |
| 4,100,650 | 7/1978 | Wirth et al. | 19/105 |
| 4,222,154 | 9/1980 | Staheli et al. | 19/105 |
| 4,928,355 | 5/1990 | Leifeld | 19/105 |
| 5,038,439 | 8/1991 | Verzilli | 19/105 |
| 5,479,679 | 1/1996 | Leifeld | 19/105 |

FOREIGN PATENT DOCUMENTS

| | | |
|---|---|---|
| 0436250 | 7/1991 | European Pat. Off. . |
| 1172166 | 6/1964 | Germany . |
| 2418413 | 11/1975 | Germany . |
| 578628 | 8/1976 | Switzerland . |
| 726733 | 3/1955 | United Kingdom . |
| 930065 | 7/1963 | United Kingdom . |
| 933599 | 8/1963 | United Kingdom . |
| 1034692 | 6/1966 | United Kingdom . |
| 1209278 | 10/1970 | United Kingdom . |
| 1348930 | 3/1974 | United Kingdom . |
| 1375552 | 11/1974 | United Kingdom . |
| 2240996 | 8/1991 | United Kingdom . |

*Primary Examiner*—John J. Calvert
*Attorney, Agent, or Firm*—Spencer & Frank

[57] ABSTRACT

A fiber processing machine includes an opening roll; a feed roller positioned at a first clearance from the opening roll and a feed tray positioned at a second clearance from the opening roll. The feed tray defines a nip with the feed roller for clamping and advancing fiber material in the nip to the opening roll. A setting arrangement is provided for adjusting at least one of the first and second clearances.

12 Claims, 11 Drawing Sheets

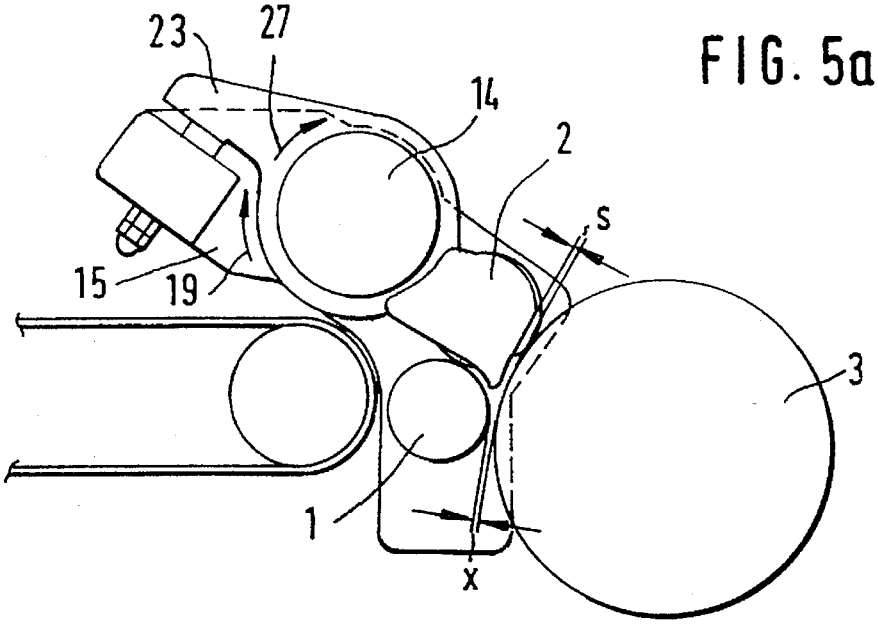
FIG. 5a
FIG. 5b
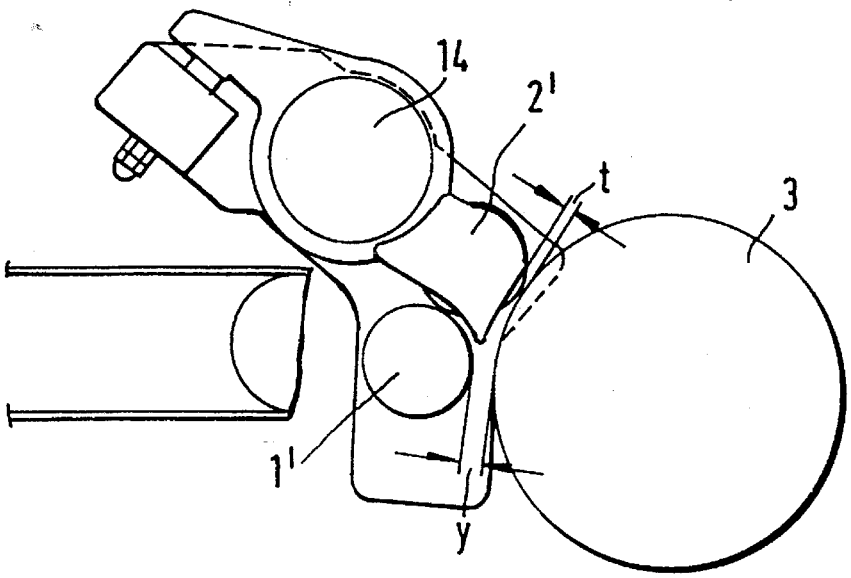

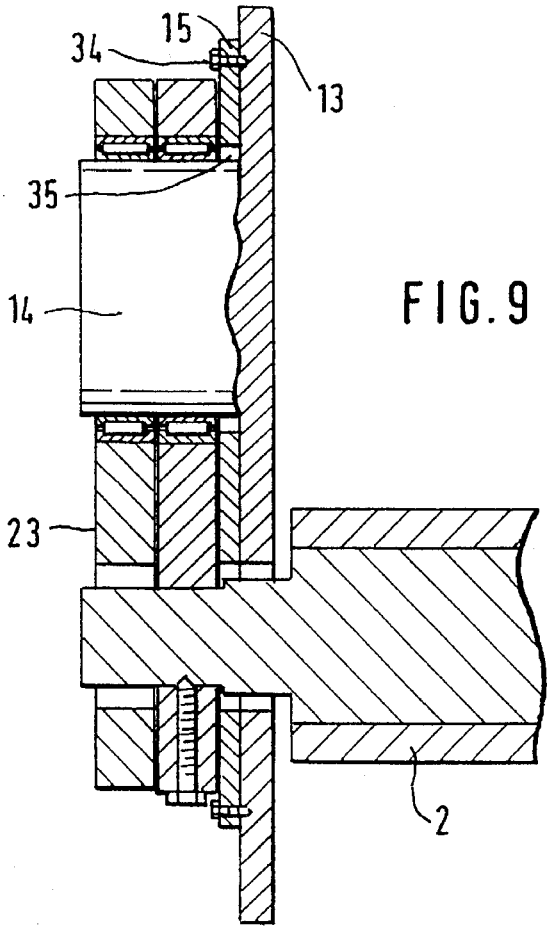
FIG. 9
FIG. 10
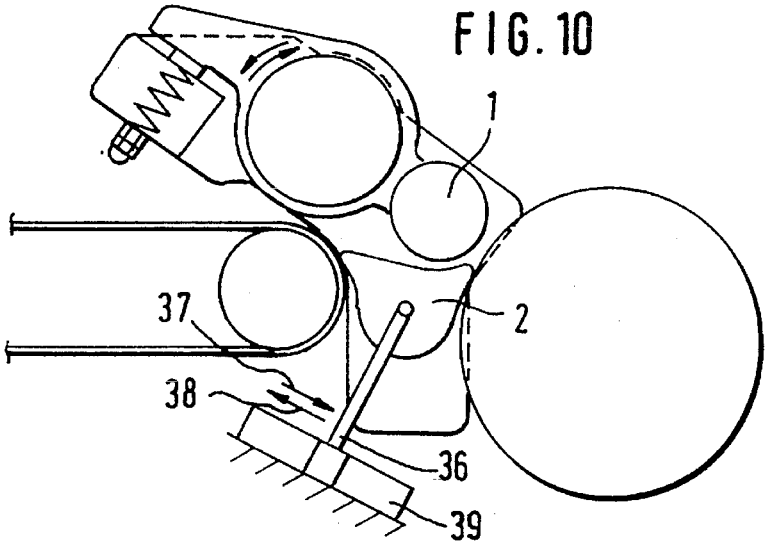

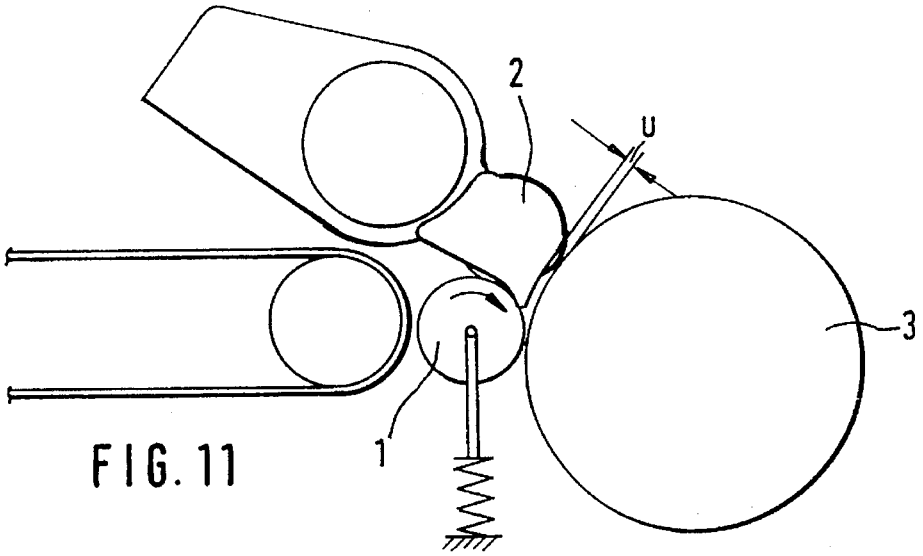
FIG. 11
FIG. 12
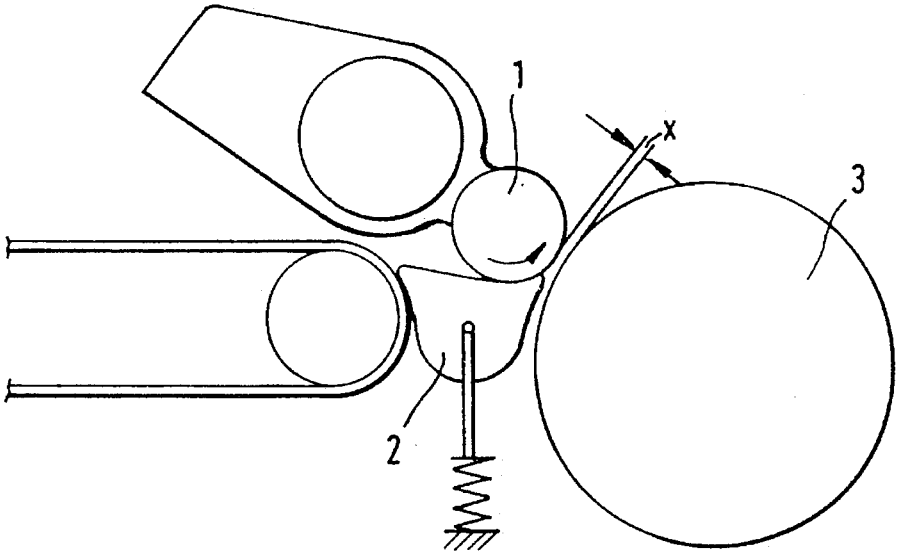

CLEARANCE ADJUSTMENT IN THE FEEDING DEVICE OF A FIBER PROCESSING TEXTILE MACHINE

CROSS REFERENCE TO RELATED APPLICATION

This application claims the priority of German Application No. P 44 41 254.1 filed Nov. 19, 1994, which is incorporated herein by reference.

BACKGROUND OF THE INVENTION

This invention relates to a fiber processing textile machine, such as a fiber tuft opener/cleaner or a carding machine for treating fiber material such as cotton, synthetic fiber or the like. The fiber processing machine includes a fiber tuft feeding device such as a feed roller cooperating with a feed tray and has at least one downstream-arranged opening device including, for example, opening rolls with a cleaning device. The fiber material passes through the feeding device and the opening device and is thereafter advanced to a further fiber processing machine.

According to a prior art arrangement, the feed tray of the feeding device is movably supported for the purpose of effecting a clamping of the fiber material by the feed roller and the feed tray.

It is a disadvantage of the above-outlined conventional arrangement that damage to the fiber material may occur if the clearance between the feed roller and the afterconnected fiber processing roll (hereafter referred to as opening roll) is maintained constant for different types of fiber material or different operating conditions.

SUMMARY OF THE INVENTION

It is an object of the invention to provide an improved fiber processing machine of the above-outlined type in which the fiber processing is ameliorated and a highly satisfactory clamping of the fiber material by the fiber feeding device is ensured in a structurally simple manner.

This object and others to become apparent as the specification progresses, are accomplished by the invention, according to which, briefly stated, the fiber processing machine includes an opening roll; a feed roller positioned at a first clearance from the opening roll and a feed tray positioned at a second clearance from the opening roll. The feed tray defines a nip with the feed roller for clamping and advancing fiber material in the nip to the opening roll. A setting arrangement is provided for adjusting at least one of the first and second clearances.

By providing an adjustability of the distance between the slowly rotating feed roller and the afterconnected, rapidly rotating opening roll, fiber damages in the processing of different fiber types or upon changing operational conditions or fiber throughput may be avoided. The transfer of the fiber material from the feed roller or the takeover of the fiber material by the opening roll is thus improved for different types of fiber, for example, for different fiber lengths. The device according to the invention is of particular advantage in high-production machines processing fibers of relatively large lengths.

According to an advantageous preferred embodiment of the invention, the clearance between the feed tray and the afterconnected opening roll is adjustable. This embodiment, particularly by providing the possibility of a narrower gap setting between the feed tray and the opening roll, is particularly adapted for processing fiber material having relatively short fibers, such as waste fibers.

BRIEF DESCRIPTION OF THE DRAWING

FIGS. 5*a* and 5*b* are schematic side elevational views of the construction of FIG. 4*a* showing different adjustments for the clearance between the feed roller and the opening roll.

FIG. 9 is a front elevational view similar to FIG. 3*a* or 3*b*, showing a variant of securement.

FIG. 10 is a schematic side elevational view similar to FIG. 8*a* or 8*b*, showing yet another preferred embodiment.

FIG. 11 is a schematic side elevational view similar to FIG. 5*a* or 5*b*, illustrating another preferred embodiment.

FIG. 12 is a schematic side elevational view similar to FIG. 11, illustrating a further preferred embodiment.

DESCRIPTION OF THE PREFERRED EMBODIMENTS

Figure 1:
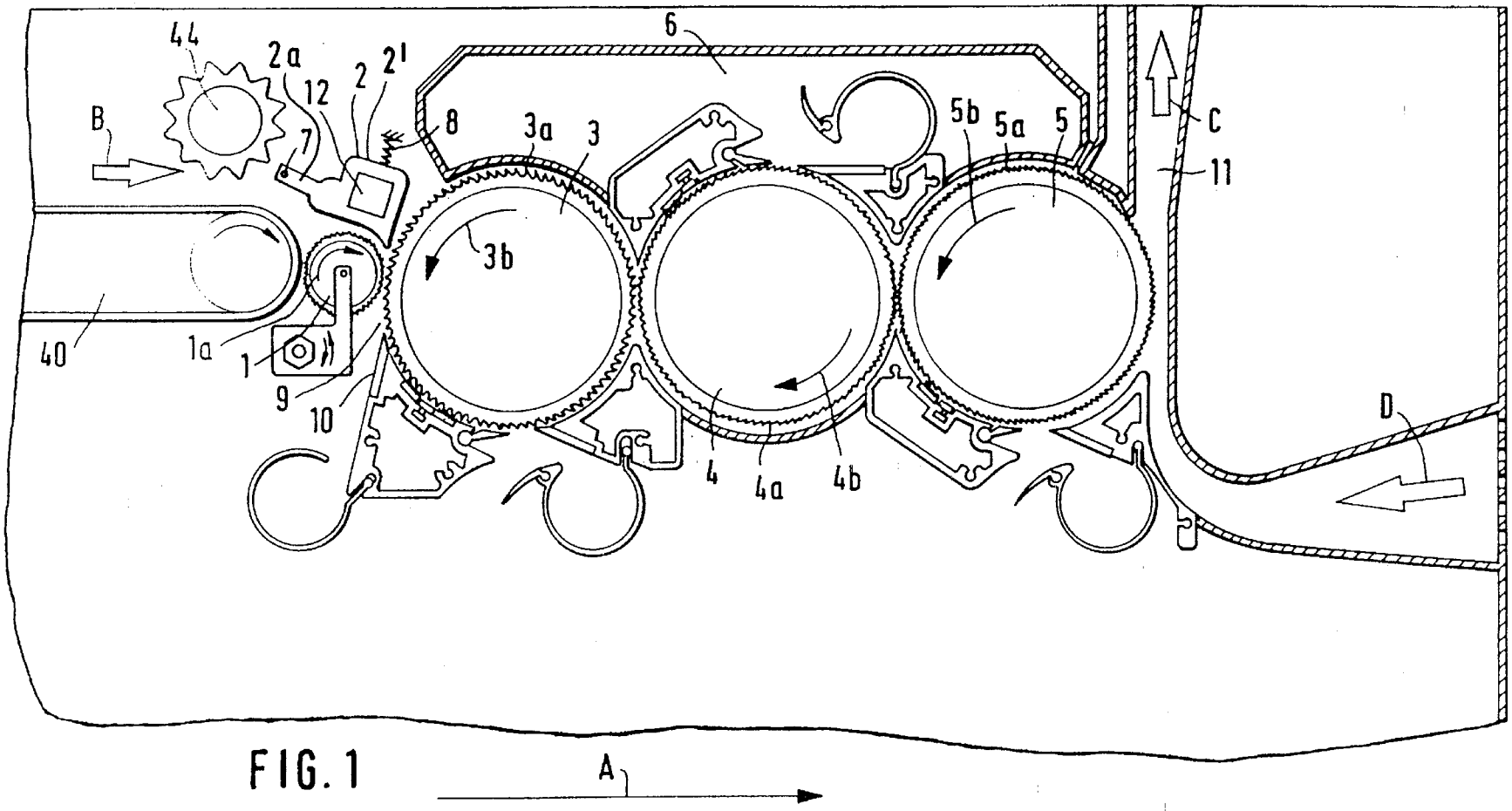
FIG. 1 is a schematic side elevational view of a three-roll fiber cleaning device incorporating the invention, including an adjustable feed roller and a resiliently supported feed tray.

Turning to FIG. 1, there is illustrated therein a fiber tuft cleaner which may be a CVT model manufactured by Tr ützschler GmbH & Co. KG, Mönchengladbach, Germany. The apparatus is disposed in a closed housing and the fiber material B, such as cotton, is introduced as a fiber tuft lap into the cleaner by, for example, a conveyor 40 in cooperation with a fiber lap pressing roller 41. The fiber mass (fiber lap) is supplied by the components 40, 41 to a feeding device composed of two feeding members, such as a feed roller 1 and a feed tray 2. The feed roller 1 and the feed tray 2 clamp the fiber lap and advance the same to a rapidly rotating pin roll 3. The pin roll 3 may have a diameter of, for example, 250 mm and is rotatably held in the cleaner housing for a counterclockwise rotation as indicated by the arrow 3*b*. The pin roll 3 is followed by sawtooth rolls 4 and 5. The sawtooth roll 4 may have a diameter of approximately 250 mm. The pin roll 3 and the sawtooth roll 4 may have a circumferential speed of, for example, 15 m/sec and 20 m/sec, respectively. The circumferential speed of the sawtooth roll 5 is greater than that of the sawtooth roll 4. The diameter of the sawtooth roll 5 is also approximately 250 mm. The pin roll 3 is surrounded by a housing 6 and is associated with a discharge opening 9 for ejecting fiber impurities whose size is adapted to the grade of soiling of the cotton. The waste outlet opening 9 is bordered by a mote knife.

The feeding device includes the slowly rotating feed roller 1 rotating in the direction of the arrow 1*a* and the feed tray 2 situated above the feed roller 1. The feed tray 2 is supported at one end of a lateral extension 2*a* in a rotary bearing 7. The outer upper feed tray surface 2' is contacted by a compression spring 8 which resiliently loads the feed tray 2. The rotary support for the feed roller 1 is stationary.

The above described device operates as follows:

The fiber lap B formed of fiber tufts is clamped by the feed roller 1 and the feed tray 2 and is advanced to the pin roll 3 which combs the fiber material and entrains, on its pins, fiber bundles from the fiber lap. As the material, carried in a circular path by the pins of the roll 3 passes by the waste discharge opening and the mote knife 10, dependent upon the circumferential speed and the curvature of the pin roll 3 as well as the size of the waste discharge opening 9, short fibers and coarse impurities are thrown out of the material by centrifugal forces. The fiber material pre-cleaned in this manner is taken over by the points 4*a* of the sawtooth roll 4 from the pin roll 3 and performs additional opening operations thereon. Thereafter the fiber material is taken over by the points 5*a* of the sawtooth roll 5 which is located immediately downstream of the roll 4, as viewed in the working direction A. The roll 5 further opens the fiber material and advances it to a pneumatic removal device 11 which transports the fiber material to a non-illustrated further fiber processing machine.

The feed tray 2 is an elongated, extruded aluminum component having a cavity which extends along the length of the feed tray, that is, along the width dimension of the cleaning apparatus and accommodates an elongated element, such as a steel bar (steel core) 12 which is resistant to bending and thus prevents undesired flexing of the feed tray 2 along its length.

Figure 3A:
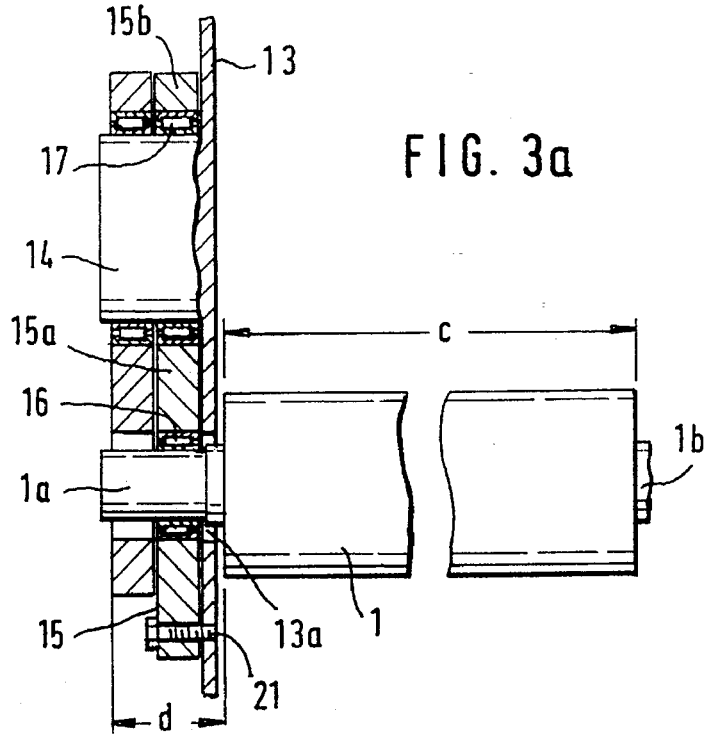
FIG. 3*a* is a sectional view taken along line IIIa—IIIa of FIG. 2*a*.
Figure 3B:
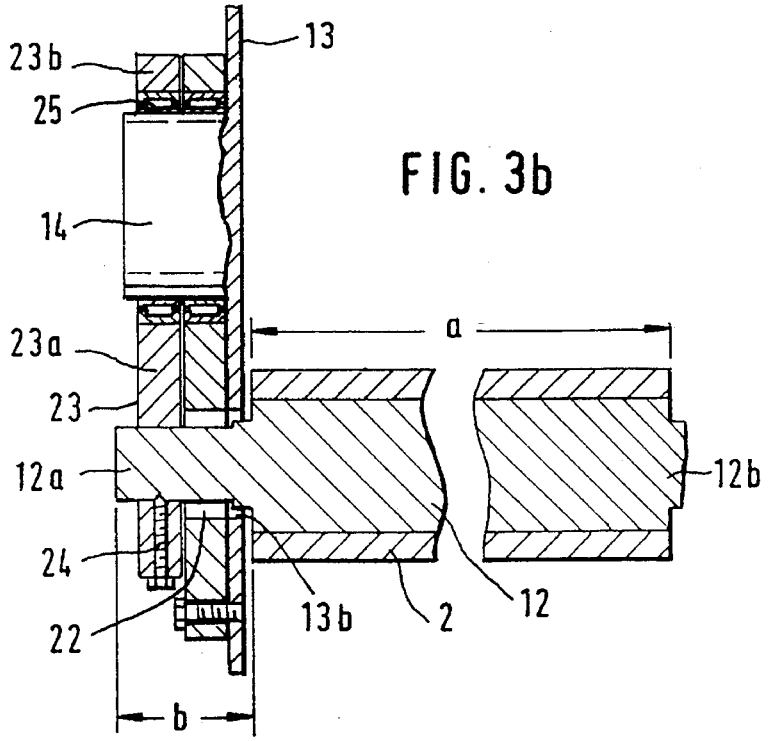
FIG. 3*b* is a sectional view taken along line IIIb—IIIb of FIG. 2*b*.
Figure 7A:
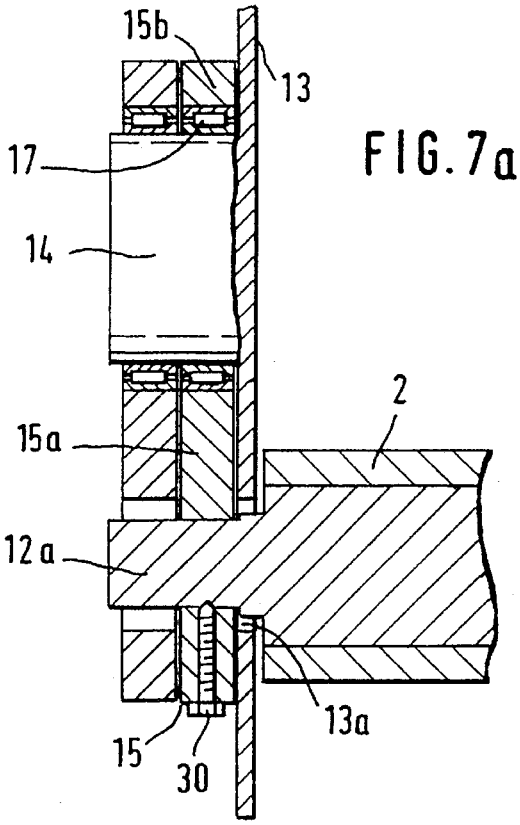
FIG. 7*a* is a sectional view taken along line VIIa—VIIa of FIG. 6*b*.

As shown in FIGS. 3*b* and 7*a*, the steel bar 12 has, at its opposite ends, stepped-down extensions 12*a*, 12*b* which have a length b and which serve for supporting the feed tray 3 in the machine frame. The extension 12*a* which passes through an opening 13*a* in the machine stand 13, is, for example, by a screw 24, secured in a lever arm 23*a* of a holding element 23 which is pivotal in the direction 26 and 27 in a rotary bearing (such as a ball bearing) 25 about a cylindrical pivot pin 14 affixed to the machine frame 13. The rotary axis of the holding element 23 is perpendicular to the direction of fiber feed and parallel to the length dimension of the feed tray 2. Another lever arm 23*b* of the holding element 23 is engaged by a compression spring 28, against the force of which the feed tray 2 executes excursions in case of a thickness variation of the lap B. The machine frame 13 further carries a stop 29 which determines the minimum clearance between the feed roller 1 and the feed tray 2.

Figure 2A:
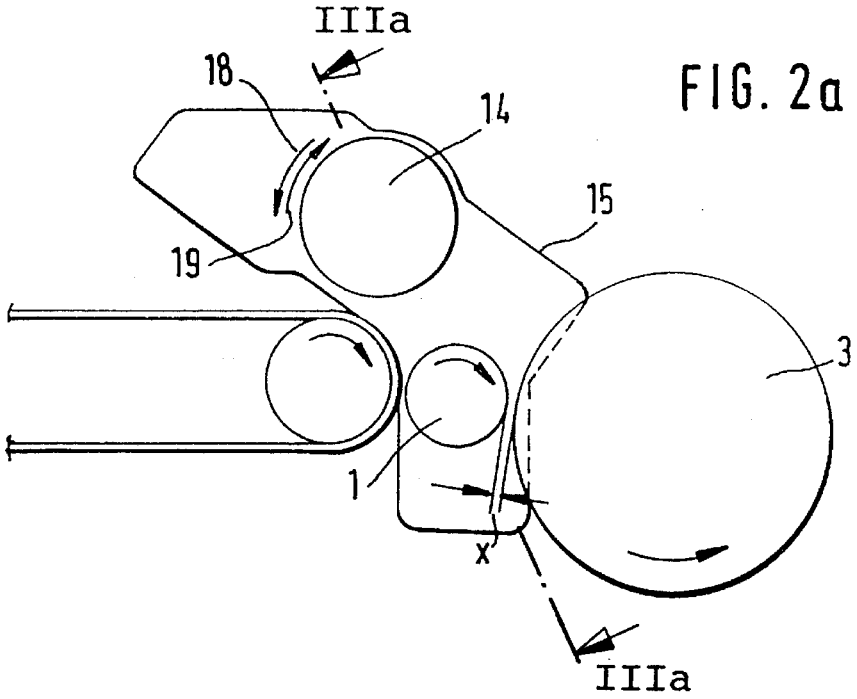
FIG. 2*a* is a schematic side elevational view of an adjustably supported feed roller according to a preferred embodiment of the invention.
Figure 4A:
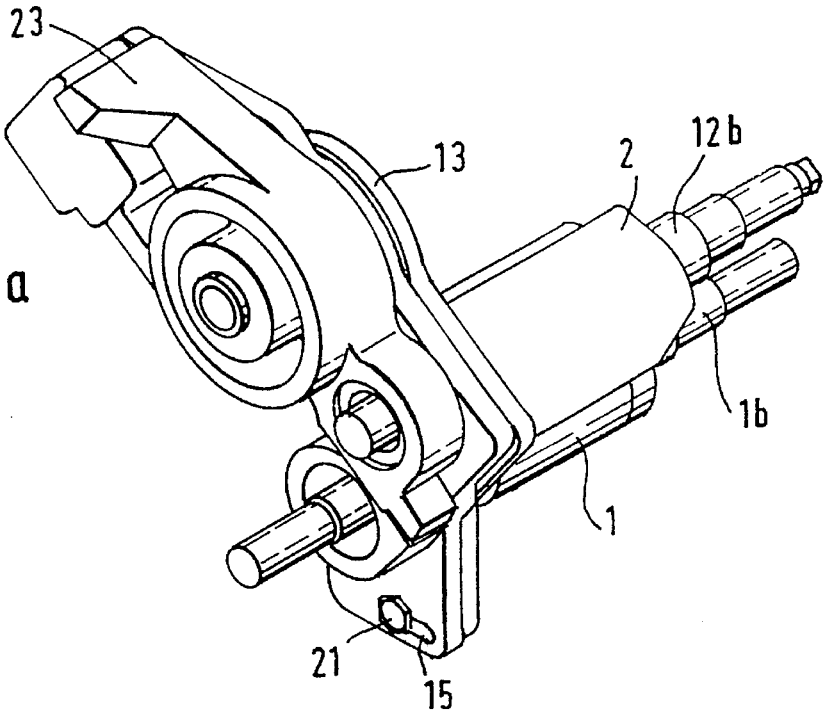
FIG. 4*a* is a perspective view of the preferred embodiment.
Figure 4B:
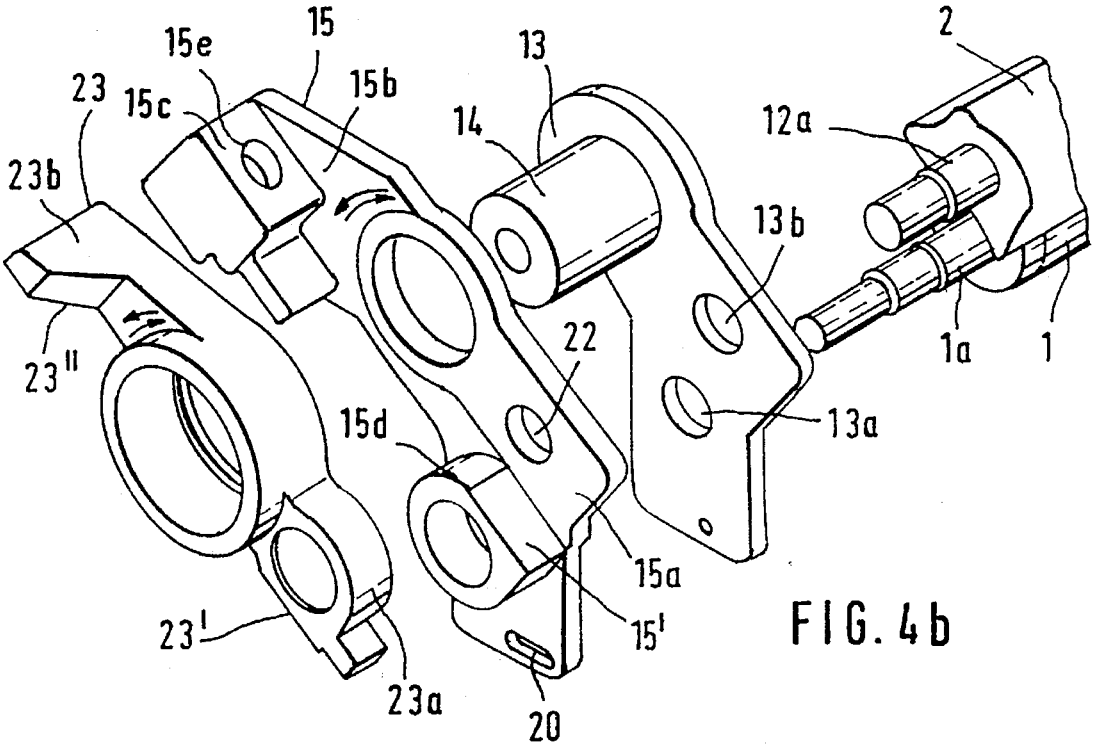
FIG. 4*b* is a perspective exploded view of the construction shown in FIG. 4*a*.

Turning to FIGS. 2*a* and 3*a*, in a machine frame plate 13 an opening 13*a*is provided through which an extension (stub) 1*a* of the feed roller 1 passes. It is noted that the same construction is provided for the opposite stub 1*b* of the feed roller 1. On the outside of the plate 13 a cylindrical bearing pin 14 is mounted. Further, on the side of the machine frame plate 13, oriented away from the feed roller 1, a dual-lever adjusting element 15 is provided, having a lever arm 15*a*, in which the stub 1*a* of the feed roller 1 is supported by means of a ball bearing 16. The adjusting element 15 is supported by a ball bearing 17 on the bearing pin 14 for rotation in the direction designated by arrows 18 and 19. In the adjusting element 15 a slot 20 is provided (as shown in FIGS. 4*a* and 4*b*) through which a setting and securing screw 21 passes. Along the slot 20 scale markings (not shown) may be provided on the adjusting element 15. The screw 21 is in engagement with threads provided in a corresponding hole of the frame plate 13. The slowly rotating feed roller 1 and the rapidly rotating opening roll 3 are at a peripheral distance (clearance) x from one another.

Figure 2B:
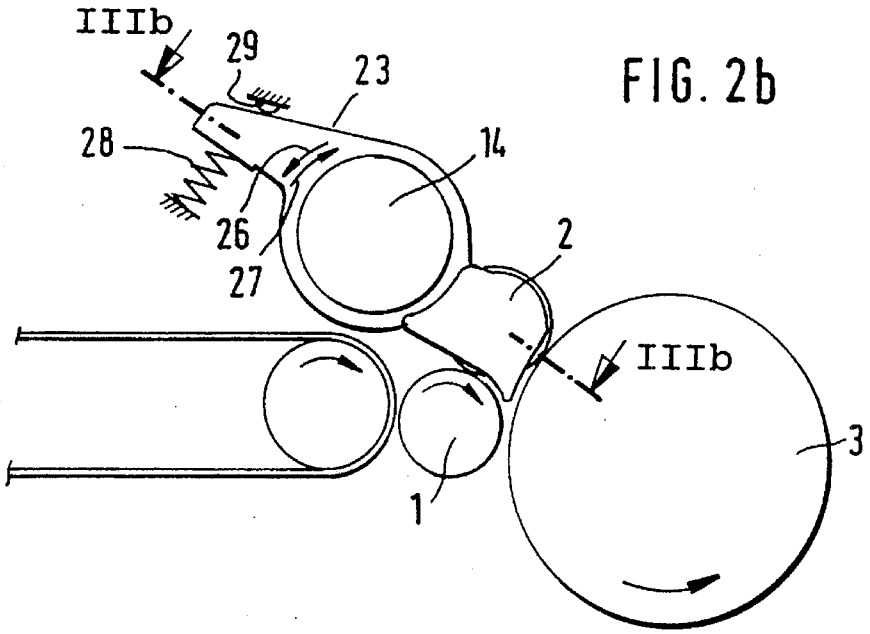
FIG. 2*b* is a schematic side elevational view of a resiliently supported feed tray according to the preferred embodiment.

Turning to FIGS. 2*b* and 3*b*, the stub 12*a* of the steel core 12 of the feed tray 2 passes through the opening 13*b* provided in the frame plate 13. The same, non-illustrated, construction for the other, opposite stub 12*b* of the steel core 12 is present on the other side of the machine. The stub 12*a* also passes through an opening 22 of the adjusting element 15. Parallel to the adjusting element 15 there is provided a dual-arm holding element 23 whose lever arm 23*a* supports the stub 12*a* to which it is secured by means of a screw 24. The other lever arm 23*b* is biased by the spring 28 and engages an abutment 29 to prevent contact between the feed roller 1 and the feed tray 2. The openings 13*a* and 13*b* provided in the stationary frame plate 13 are sufficiently large to allow radial displacements therein of the stubs 1*a* and 12*a* as will be described below.

Also referring to the perspective FIGS. 4*a* and 4*b*, the compression spring 28 accommodated in a bore hole 15*e* of the projection 15*c* presses against the surface 23" of the lever arm 23*b* whereby the surface 23' of the lever arm 23*a* is pressed against the surface 15' of the projection 15*d*. The pressing force exerted by the spring 28 is adjustable, for example, by means of a non-illustrated setscrew held in a threaded portion of the bore hole 15*e* and serving as a countersupport for the spring 28.

When the screw 21 shown in FIG. 4*a* is loosened, and the adjusting element 15 is turned in the direction of the arrow 19 (FIG. 5*a*), the distance x between the feed roller 1 and the opening roll 3 is increased, for example, from 1.3 mm to a distance y (FIG. 5*b*) of, for example, 2.5 mm. The feed roller 1 moves into the position 1' as shown in FIG. 5*b*, whereas the feed tray 2 assumes its position as indicated at 2' in FIG. 5*b* to increase its distance from the opening roll 3 from s to t. While the clearance x is changed directly by pivoting the adjusting element 15, the distance a between the feed tray 2 and the opening roll 3 is indirectly changed by virtue of the connection between the adjusting element 15 and the holding element 23. In this manner, the clearance between the outlet side of the clamping nip (which is the clearance between the feed roller 1 and the feed tray 2) and the opening roll 3 is increased (or decreased, in case of an oppositely oriented pivotal motion of the adjusting element 15 in the direction of the arrow 18 shown in FIG. 2*a*). At the same time, the holding element 23 is, by virtue of the pressure of the spring 28 turned in the same direction 27 coaxially about the pin 14 so that the surfaces 15' and 23' remain in contact with one another as shown in FIG. 4*a*. As a result, the distance between the feed roller 1 and the feed tray 2 remains the same. After the clearance adjustment is completed, the screw 21 is again tightened.

Figure 6A:
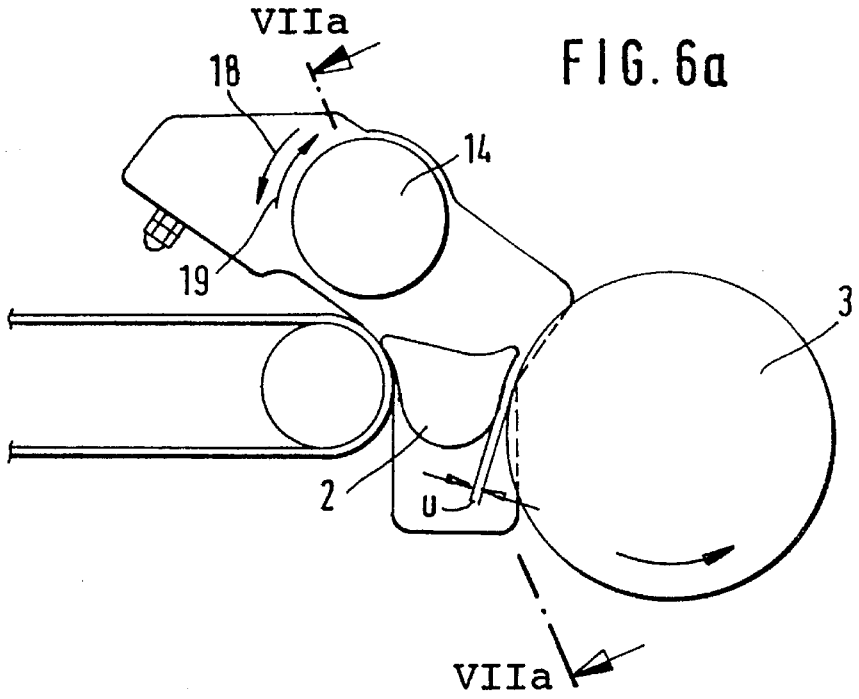
FIGS. 6*a* and 6*b* are schematic side elevational views similar to FIGS. 2*a* and 2*b*, respectively, showing another preferred embodiment where the position of the feed table and the feed roll is reversed.

Turning to FIGS. 6*a* and 7*a*, the stub 12*a* of the steel core 12 of the feed tray 2 projects through the opening 13*a* provided in the frame plate 13. The stub 12*a* received in an aperture of the lever arm 15*a* of the adjusting element 15 is secured thereto by means of a screw 30. The adjusting element 15 is rotatably supported about the bearing pin 14 for angular displacements in the direction of the arrows 18, 19. The setting and securing screw 32 passes through the slot 20 (FIG. 4*b*) of the adjusting element 15 and threadedly engages a bore hole in the frame plate 13. The terminal edge 2*a* of the feed tray 2 is at a clearance u from the periphery of the opening roll 3.

Figure 6B:
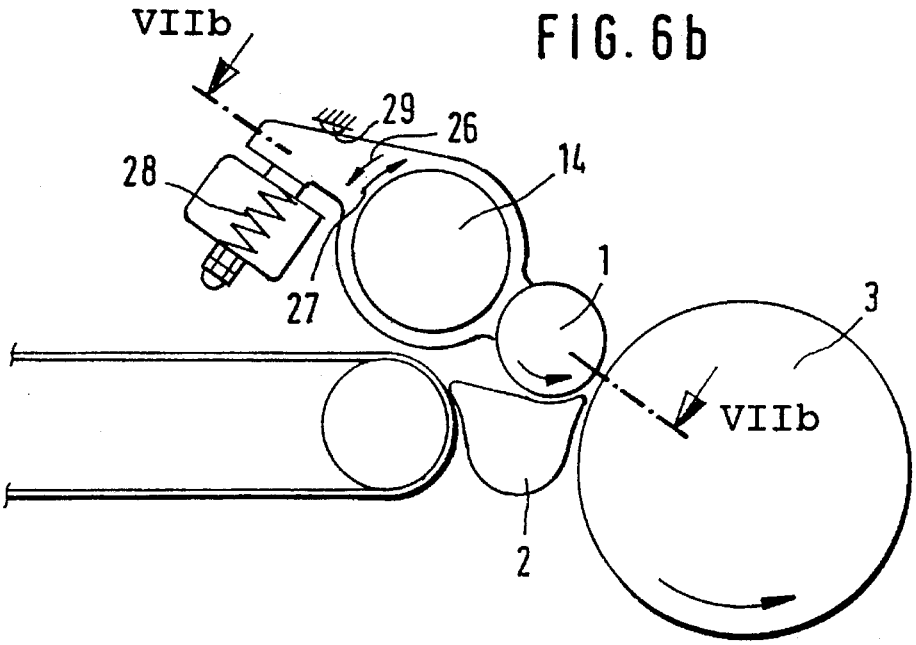
Figure 7B:
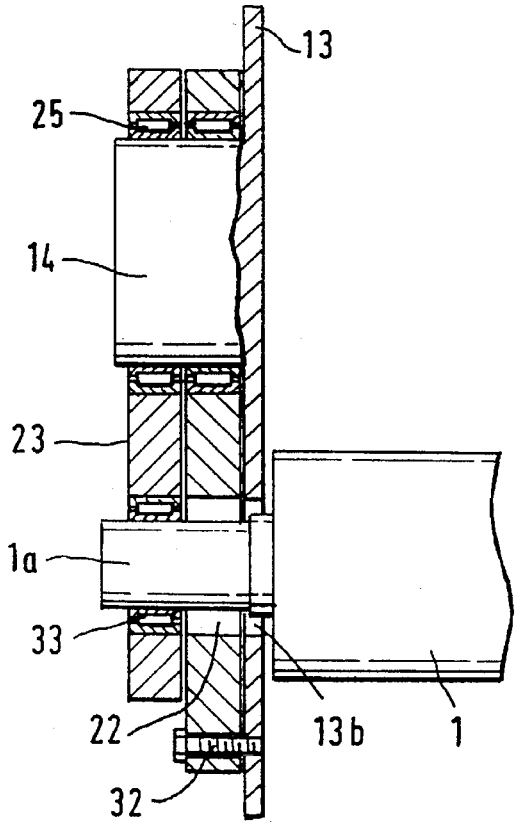
FIG. 7*b* is a sectional view taken along line VIIb—VIIb of FIG. 6*b*.

Similarly, as shown in FIGS. 6*b* and 7*b*, the stub 1*a* of the feed roller 1 projects through the opening 13*b*. The stub 1*a* also projects through the opening 22 provided in the adjusting element 15. The two-arm holding element 23 extends parallel to the adjusting element 15 and receives, in one lever arm 23*a*, the stub 1*a* with the interpositioning of a ball bearing 33. The holding element 23 is pivotal in the direction of the arrows 26, 27 about the bearing pin 14 supported thereon by the ball bearing 25. The lever arm 23 is biased by the spring 28 and engages the abutment 29. The holding element 23 is coupled to the adjusting element 15 in a manner described in connection with FIGS. 4*a*, 4*b*.

Figure 8A:
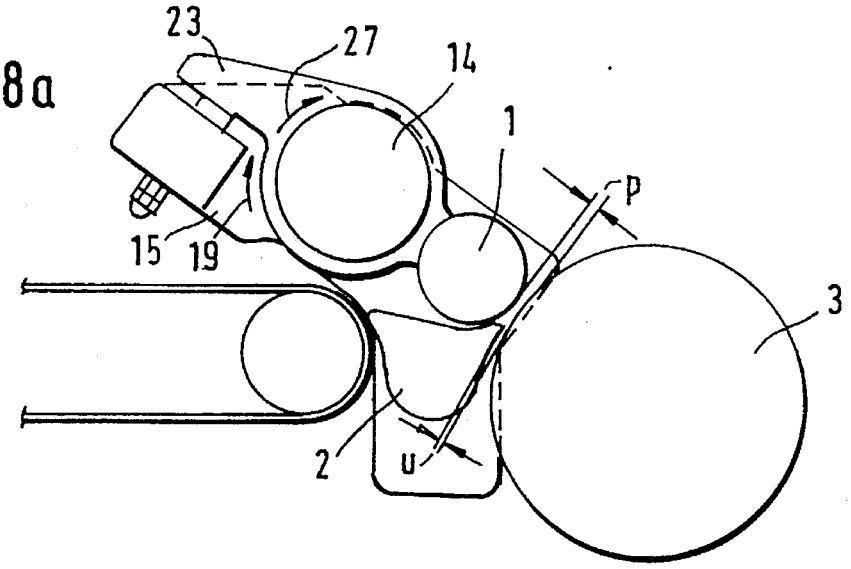
FIGS. 8*a* and 8*b* are schematic side elevational views of the constructions shown in FIGS. 6*a* and 6*b*, illustrating an adjustment of the clearance between the feed tray and the opening roll.
Figure 8B:
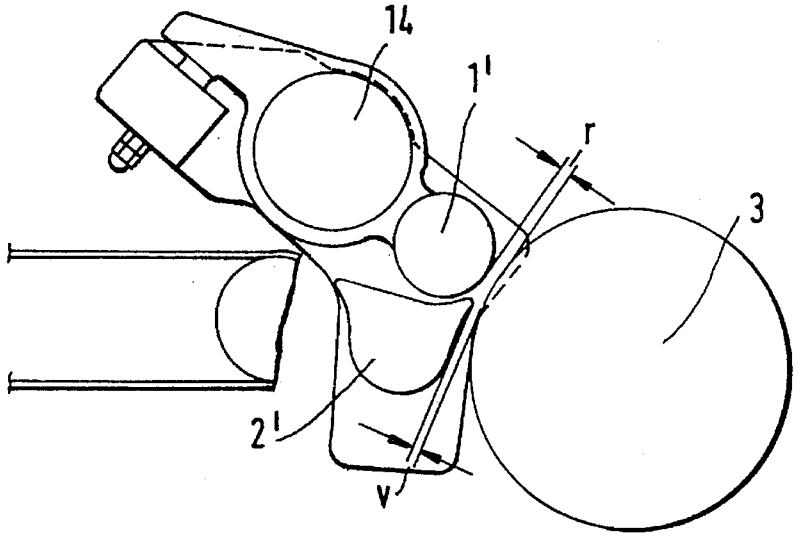

Upon loosening the screw 32 and turning the adjusting element 15 according to FIG. 8*a* in the direction of the arrow 19, the distance u between the feed tray 2 and the opening roll 3 shown in FIG. 8*a* is increased to the distance v as shown in FIG. 8*b*. Accordingly, the feed tray 2 moves into the position indicated at 2', increasing its distance from the opening roll 3 from p to r. The feed roller 1 moves from its position shown in FIG. 8*a* to its position indicated at 1' in FIG. 8*b*. While the distance p is changed directly by the setscrew 32, the distance r is indirectly altered by virtue of the connection between the adjusting element 15 and the holding element 23. In this manner, the distance between the outlet of the nip defined between the feed roller 1 and the feed tray 2 on the one hand and the opening roll 3, on the other hand, is increased (or decreased, in case of a rotation in the opposite direction). Also, at the same time, the holding element 23 is turned by the pressure of the spring 28 in the same direction 27 so that the surfaces 15' and 23' remain in engagement with one another, as illustrated in FIG. 4*a*. In this manner, the distance between the feed roller 1 and the feed tray 2 which defines the clamping distance for the fiber material B, remains the same even after a rotation of the adjusting element 15 and the holding element 23, that is, upon an alteration of the distance between the feed tray 2 and the opening roll 3. After such adjustment, the setscrew 32 is again tightened.

As shown in FIG. 9, the adjusting element 15 is secured to the frame plate 13 by a screw 34 which, at the same time, functions as a rotary bearing for the adjusting element 15. While the holding element 23 is rotatable about the bearing pin 14, the adjusting element 15 is movable axially parallel thereto about the rotary bearing constituted by the screw 34. To transmit displacement forces, in the adjusting element 15 an opening 35 is provided through which the bearing pin 14 extends.

As shown in FIG. 10, the feed roller 1 and the feed tray 2 are mounted on a holding device 36 which is linearly displaceable in the direction of arrows 37 and 38 on a stationary base 39. By virtue of this arrangement, the distance between the feed roller 1 and the feed tray 2 on the one hand and the periphery of the opening roll 3, on the other hand, may be changed and set.

The above-described embodiments relate to an arrangement where the adjustable feed roller is situated below the spring biased feed tray (FIGS. 2*a*, 2*b*, 3*a*, 3*b*, 4*a* and 4*b*) and to an arrangement where an adjustable feed tray is situated below a spring biased feed roller (FIGS. 6*a*, 6*b*, 7*a* and 7*b*). The invention may also encompass an arrangement where there is provided a spring biased feed roller below an adjustable feed tray as shown in FIG. 11 and a device having a spring biased feed tray below an adjustable feed roller, as shown in FIG. 12.

Figure 13A:
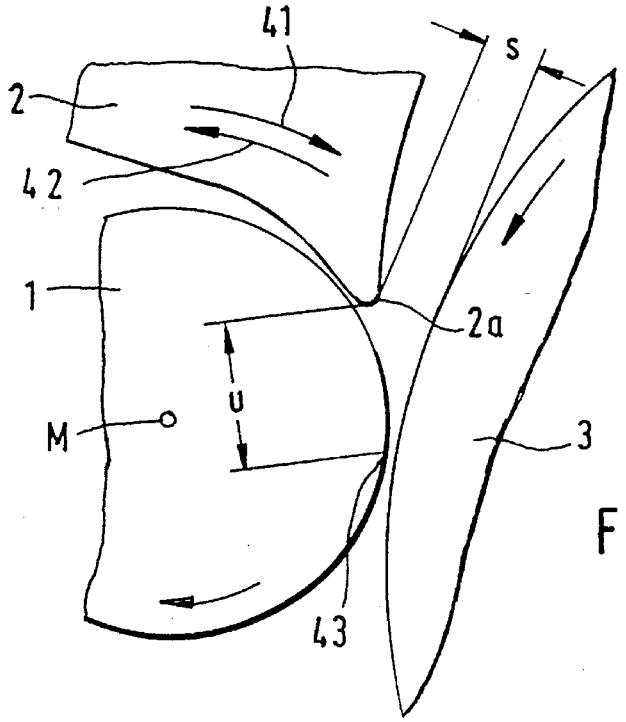
FIGS. 13*a* and 13*b* are schematic side elevational views of a feed roller, a feed table and an opening roll, illustrating different adjustments of the clearance between the terminal edge of the feed tray and the opening roll.
Figure 13B:
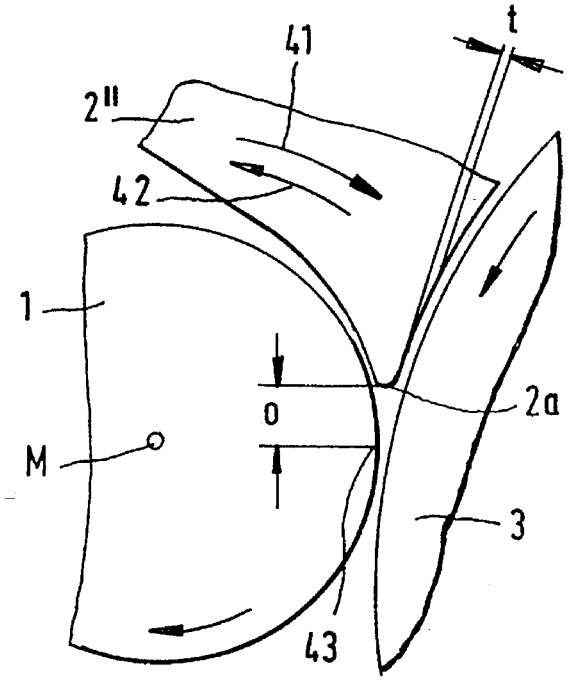

According to FIGS. 13*a* and 13*b*, a feed tray 2 is provided which is rotatable in the direction of the arrows 41 and 42 about the rotary axis M of the feed roller 1. Upon turning the feed tray 2 in the direction of the arrow 41 from its position shown in FIG. 13*a* into the position 2" shown in FIG. 13*b*, the distance s shown in FIG. 13*a* is reduced to the distance t shown in FIG. 13*b*. In this manner, the outlet of the clamping nip is relocated along the periphery of the feed roller 1. At the same time, the outlet of the clamping nip moves closer to the fiber transfer location 43, whereby a fiber beard having shorter fibers may be combed by the opening roll 3. At the same time, the distance between the outlet edge 2*a* of the feed tray 2 and the fiber transfer location 43 between the feed roller 1 and the opening roll 3 is reduced from the distance u as shown in FIG. 13*a* to the distance o as shown in FIG. 13*b*.

The invention, which was described in connection with an opening roll of a fiber cleaning apparatus, may find application in a carding machine as well.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) an opening roll;

(b) a feeding device including (1) a first feeding member positioned at a first clearance from said opening roll;

(2) a second feeding member positioned at a second clearance from said opening roll; one of said first and second feeding members being a feed roller and one of said first and second feeding members being a feed tray; said feed tray defining a nip with said feed roller for clamping and advancing fiber material in said nip to said opening roll; and (c) setting means for adjusting at least one of said first and second clearances; said setting means including (1) an adjusting element carrying said first feeding member;

(2) a holding element carrying said second feeding member;

(3) a first stationary pivot for pivotally supporting said adjusting element in a first plane;

(4) a second stationary pivot for pivotally supporting said holding element in a second plane; said first and second planes being parallel to one another;

(5) resilient means for resiliently urging said first feeding member and said second feeding member towards one another;

(6) coupling means for connecting said adjusting element with said holding element for movement of said holding element and said adjusting element as a unit upon displacement of said adjusting element, whereby upon a displacement of said adjusting element said first feeding member and said second feeding member are displaced in unison for simultaneously varying said first clearance and said second clearance; and (7) arresting means for immobilizing said adjusting element in an adjusted position.

2. A fiber processing machine comprising (a) an opening roll;

(b) a feeding device including (1) a first feeding member positioned at a first clearance from said opening roll;

(2) a second feeding member positioned at a second clearance from said opening roll; one of said first and second feeding members being a feed roller and one of said first and second feeding members being a feed tray; said feed tray defining a nip with said feed roller for clamping and advancing fiber material in said nip to said opening roll; and (c) setting means for adjusting at least one of said first and second clearances; said setting means including means for linearly shifting said feed roller and said feed tray as a unit.

3. A fiber processing machine comprising (a) an opening roll;

(b) a feeding device including (1) a first feeding member positioned at a first clearance from said opening roll;

(2) a second feeding member positioned at a second clearance from said opening roll; one of said first and second feeding members being a feed roller and one of said first and second feeding members being a feed tray; said feed tray defining a nip with said feed roller for clamping and advancing fiber material in said nip to said opening roll; and (c) setting means for adjusting at least one of said first and second clearances; said setting means including (1) an adjusting element carrying said first feeding member;

(2) a holding element carrying said second feeding member;

(3) stationary support means for movably supporting said adjusting element and said holding element for displacements relative to one another;

(4) resilient means for resiliently urging said first feeding member and said second feeding member towards one another;

(5) coupling means for connecting said adjusting element with said holding element for movement of said holding element and said adjusting element as a unit upon displacement of said adjusting element, whereby upon a displacement of said adjusting element said first feeding member and said second feeding member are displaced in unison for simultaneously varying said first clearance and said second clearance; and (6) arresting means for immobilizing said adjusting element in an adjusted position.

4. The fiber processing machine as defined in claim 3, wherein said resilient means comprises a spring connected between said adjusting element and said holding element.

5. The fiber processing machine as defined in claim 3, further comprising a stationary abutment situated in a path of displacement of said holding element for determining a minimum clearance between said feed roller and said feed tray.

6. The fiber processing machine as defined in claim 3, wherein said stationary support means comprises a pivot coaxially supporting said adjusting element and said holding element for pivotal motions of said adjusting element and said holding element in parallel planes.

7. The fiber processing machine as defined in claim 6, wherein said arresting means comprises a tightening screw passing through said adjusting element and being received by a stationary machine component.

8. The fiber processing machine as defined in claim 6, wherein said adjusting element includes a first lever arm extending from said pivot and a second arm extending from said pivot; said second arm supporting said first feeding member; further wherein said holding element includes a first lever arm extending from said pivot and a second arm extending from said pivot; said second arm of said holding element supporting said second feeding member.

9. The fiber processing machine as defined in claim 8, wherein said resilient means includes a compression spring connected between said first lever arm of said adjusting element and said first lever arm of said holding element for angularly urging the first lever arms away from one another.

10. The fiber processing machine as defined in claim 8, wherein said second lever arm of said adjusting element has a first engagement face and said second lever arm of said holding element has a second engagement face; said first and said second engagement faces being urged into contact with one another by said spring; said coupling means being formed by said first and second engagement faces.

11. A fiber processing machine comprising (a) an opening roll;

(b) a feed roller positioned at a first clearance from said opening roll;

(c) a feed tray positioned at a second clearance from said opening roll; said feed tray defining a nip with said feed roller for clamping and advancing fiber material in said nip to said opening roll;

(d) setting means for adjusting said feed roller and said feed tray relative to one another; and (e) displacing means for moving said setting means, said feed roller and said feed tray together as a single unit for adjusting the single unit relative to said opening roll.

12. A fiber processing machine comprising (a) an opening roll;

(b) a feed roller positioned at a first clearance from said opening roll and having a rotary axis; said first clearance defining a fiber transfer location from said feed roller to said opening roll;

(c) a feed tray positioned at a second clearance from said opening roll; said feed tray defining a nip with said feed roller for clamping and advancing fiber material in said nip to said opening roll; said nip having an outlet end positioned at a second distance from said fiber transfer location; and (d) setting means for angularly adjusting said feed tray with respect to said feed roller about said rotary axis of said feed roller for varying said second clearance.

* * * * *